US008528462B2

(12) United States Patent
Pacht

(10) Patent No.: US 8,528,462 B2
(45) Date of Patent: Sep. 10, 2013

(54) COUPLING ARRANGEMENT PROVIDING AN AXIAL SPACE BETWEEN A PLUNGER AND PLUNGER ADAPTOR OF A HIGH PRESSURE FLUID PUMP

(75) Inventor: Amos Pacht, Houston, TX (US)

(73) Assignee: Gardner Denver Water Jetting Systems, Inc., Houston, TX (US)

( * ) Notice: Subject to any disclaimer, the term of this patent is extended or adjusted under 35 U.S.C. 154(b) by 886 days.

(21) Appl. No.: 12/638,050

(22) Filed: Dec. 15, 2009

(65) Prior Publication Data

US 2011/0142699 A1 Jun. 16, 2011

(51) Int. Cl.
*F01B 29/00* (2006.01)
*F01B 1/00* (2006.01)

(52) U.S. Cl.
USPC ..... 92/128; 92/147

(58) Field of Classification Search
USPC ..... 92/128, 129, 146, 147, 161; 29/888.021
See application file for complete search history.

(56) References Cited

U.S. PATENT DOCUMENTS

| | | | |
|---|---|---|---|
| 1,902,038 | A | 3/1933 | McAllister |
| 4,160,626 | A | 7/1979 | Bell |
| 4,277,229 | A | 7/1981 | Pacht |
| 5,302,087 | A | 4/1994 | Pacht |
| 5,507,219 | A | 4/1996 | Stogner |
| 6,113,304 | A | 9/2000 | Tremoulet, Jr. et al. |
| 6,241,492 | B1 | 6/2001 | Pacht |
| 6,886,832 | B2 | 5/2005 | Forrest |
| 7,121,812 | B2 | 10/2006 | Forrest |
| 7,182,016 | B2 | 2/2007 | Forrest |
| 2002/0079383 | A1 | 6/2002 | Forrest |
| 2004/0161351 | A1 | 8/2004 | Forrest |
| 2004/0178285 | A1 | 9/2004 | Forrest |

FOREIGN PATENT DOCUMENTS

| | | |
|---|---|---|
| JP | 11037058 | 2/1999 |

OTHER PUBLICATIONS

Schematic portion of a pump Nov. 1996 (1 page).
The International Search Report and Written Opinion related to international application No. PCT/US2010/057614, mailed Jan. 27, 2011.
The International Preliminary Report on Patentability related to international application No. PCT/US2010/057614, mailed Mar. 5, 2012.
A computer translation of JP11037058 A, concurrently disclosed.
Corrected International Report on Patentability , mailed Mar. 12, 2012, for related international application PCT/US2010/57614, filed Nov. 22, 2010 (19 pages).
First Office Action related to continuation in part U.S. Appl. No. 12/710,919, filed Feb. 23, 2010.

*Primary Examiner* — Michael Leslie
(74) *Attorney, Agent, or Firm* — James B. Conte; Husch Blackwell LLP

(57) ABSTRACT

A coupling for a pump connects a plunger to a plunger adaptor. The coupling provides a space between an end of the plunger and an end of the adaptor. Upon disconnecting the plunger from the adaptor, the space provides for removal of the plunger from and through a well of the pump.

8 Claims, 9 Drawing Sheets

COUPLING ARRANGEMENT PROVIDING AN AXIAL SPACE BETWEEN A PLUNGER AND PLUNGER ADAPTOR OF A HIGH PRESSURE FLUID PUMP

FIELD OF INVENTION

The present invention relates to a high pressure fluid pump having a coupling arrangement providing a space between a plunger end and a plunger adaptor end of the pump.

BACKGROUND

U.S. Pat. No. 5,302,087 discloses a high pressure pump. The pump has a plunger or pump piston linearly movable within a pump chamber during stroking of the pump. A suitable coupling is depicted for interconnecting the pump piston and drive housing output rod.

U.S. Pat. No. 4,277,229 discloses a high pressure fluid delivery system. The high pressure fluid system has a plunger with a threaded end for connection to a driving source which reciprocates the plunger along the longitudinal axis thereof.

Prior art FIG. 1 discloses a sectional view of a high pressure pump having an "L" or sectional design. FIG. 1 generally illustrates the components which form the pump. The pump has a fluid end assembly 10. The pump has a power end assembly 12. A frame 14 connects the fluid end assembly 10 to the power end assembly 12. The cross head 32 of the pump is positioned within the power end assembly in an orientation which would place the plunger 16 at the end of its suction stroke or beginning of its discharge stroke if the plunger 16 were assembled to the plunger adaptor 30.

FIG. 1 shows the fluid end assembly 10 partially disassembled to illustrate how one typically removes plunger 16 from the high pressure pump. Removal of the plunger 16 requires disassembly of suction manifold 18 from fluid cylinder block 20. Disassembly requires unscrewing bolts 22 to release suction manifold 18 from cylinder block 20. Additionally, removal of the plunger requires removal of suction valve assembly 24 from valve seat support 26 of fluid cylinder block 20. Once the suction manifold and valve assembly have been removed, one can remove plunger 16 by pulling plunger 16 axially away from the pump's power end 12*a* and fluid end 10*a*, thereby uncoupling an end 17 of a plunger 16 from coupling 28 of pony rod or plunger adaptor 30. The plunger is thus removed in the direction shown by arrow 31.

SUMMARY

Figure 1:
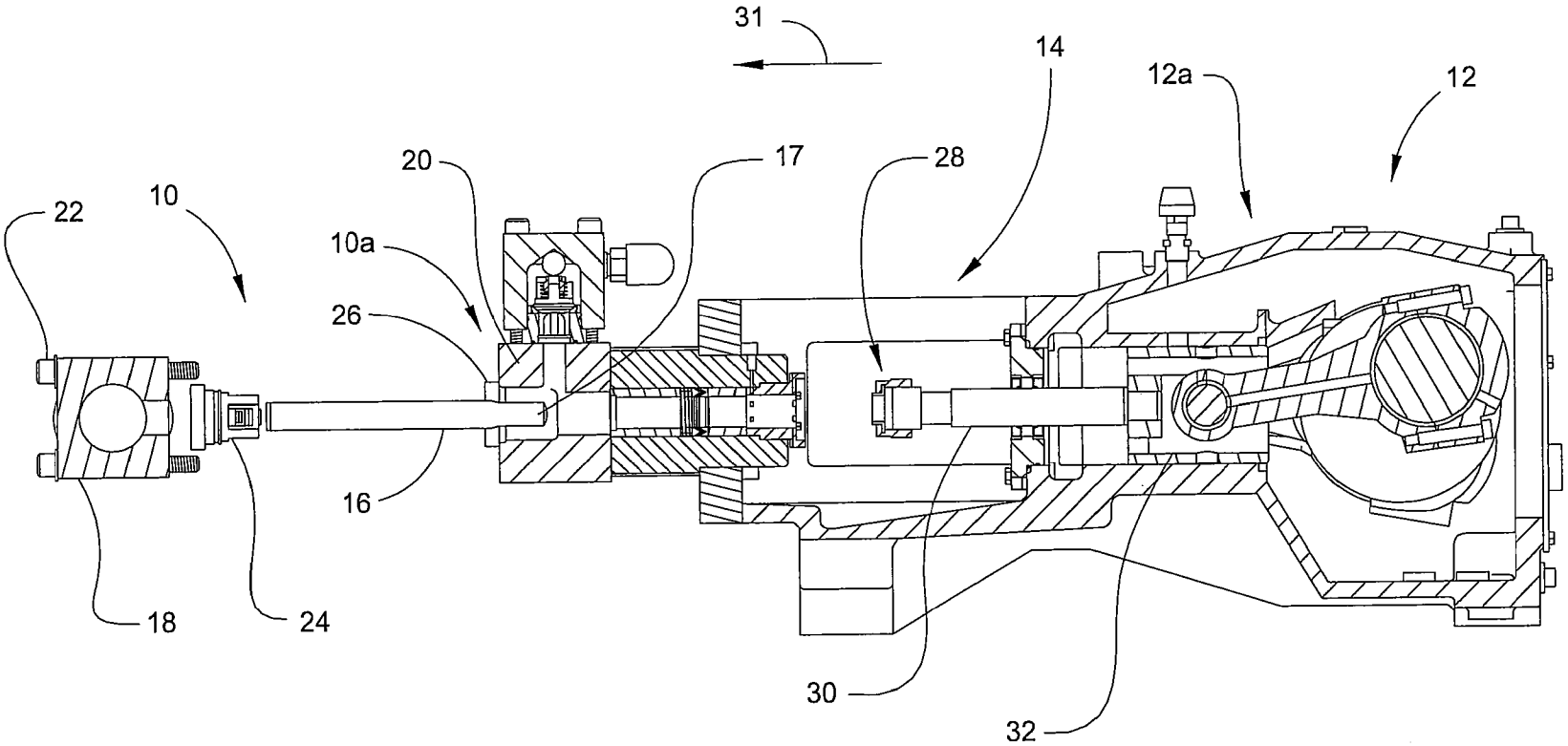
PRIOR ART Fig. 1
FIG. 1 is a prior art irregular sectional view of a high pressure pump partially disassembled.

An example of a pump assembly embodying the present invention includes a pump frame. The frame defines a well. The well has an open end. A stuffing box is engaged with the frame. The stuffing box has an opening. A plunger having a first end with an end surface and a second end with an end surface is linearly movable in the well. The plunger is movable between a first position, wherein the plunger is at the beginning of a discharge stroke, and a second position, wherein the plunger is at an end of a discharge stroke.

The assembly further includes a plunger adaptor. The plunger adaptor has a first end with an end surface and a second end. The plunger adaptor is linearly movable in the well. The plunger adaptor is movable between a first position, wherein the plunger adaptor is at a beginning of said discharge stroke and a second position, wherein said plunger adaptor is at an end of said discharge stroke.

A space is between the plunger and the plunger adaptor. The space has a longitudinal length. The longitudinal length can be measured along a longitudinal axis of the plunger.

The assembly also includes an orientation selectable from a group of orientations. One selectable orientation is an assembled orientation wherein a coupling connects the plunger to the plunger adaptor, and the coupling spans the longitudinal length. Another orientation is a partially disassembled orientation wherein said plunger and plunger adaptor are not connected by the coupling, but in all other respects the assembly is the same.

The longitudinal length of the space is at least great enough to enable movement of the end surface of the second plunger end out of the stuffing box and into the well and out of the well open end, when the pump assembly is in the partially disassembled orientation, and when the plunger adaptor first end is in the well.

In the above example, when the pump assembly is in the assembled orientation, the coupling has a first section removably coupled to a second section. Also in this example the coupling has a first end with a recess, and the plunger first end is in the recess. The coupling has a second end with a recess, and the plunger adaptor first end is in the recess. Further a spacer is between the coupler first section and the coupler second section. The spacer prevents the first section from abutting up against the second section. There is a clearance between the surfaces defining the coupler recesses and the surfaces defining the plunger first end and plunger adaptor first end. The surfaces overlap. The coupling first end is clamped to the first plunger end. The coupling second end is clamped to the plunger adaptor first end.

An example of a coupling embodying the present invention is a coupling having a first end and a second end with a longitudinal length between the first end and the second end. The longitudinal length is at least a longitudinal length of a space between a plunger and plunger adaptor of a pump when said coupling connects the plunger to the adaptor. The longitudinal length is at least great enough to enable removal of an end surface of the plunger out of a stuffing box of the pump and into a well defined by the pump and out of the well through a well open end when the plunger and plunger adaptor are not coupled by the coupling and when the plunger adaptor has a first end within the well.

An example of a method for partially disassembling a pump embodying the present invention is a method which includes disconnecting a plunger from a plunger adaptor and sliding the plunger in a direction away from a fluid end of the pump and towards a power end of the pump and into a well defined by the pump. The plunger is next removed from an open end of the well without disconnecting a power end assembly from a frame of said pump.

DETAILED DESCRIPTION

The below discussion and attached drawings disclose examples of an embodiment encompassing the invention. Other embodiments of the invention are contemplated and the appended claims are intended to cover such other embodiments as are within the scope and spirit of the invention.

Figure 2:
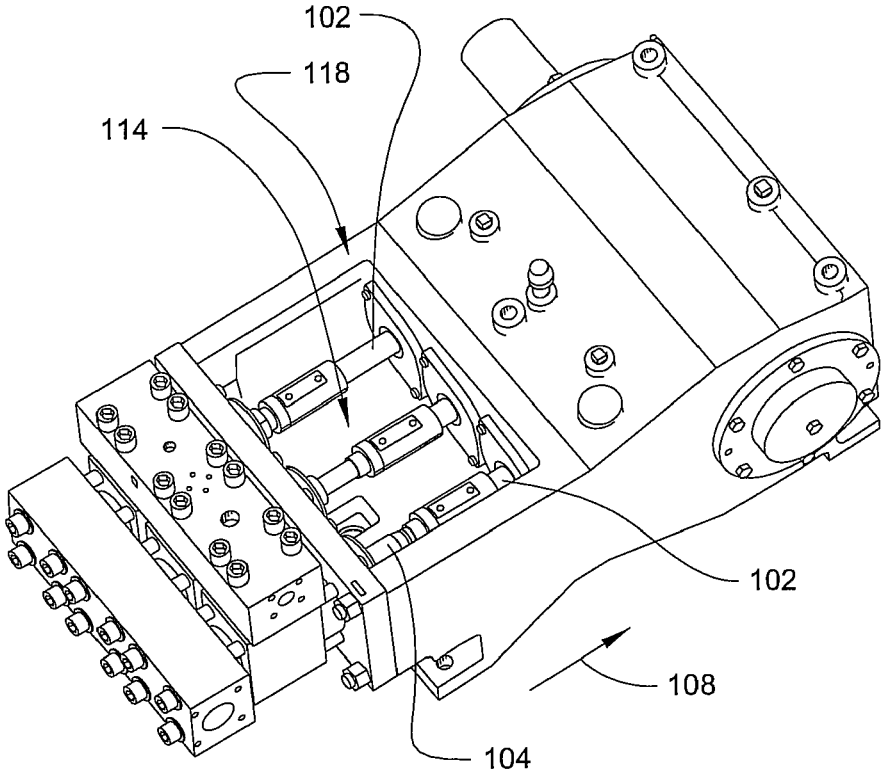
FIG. 2 is an isometric view looking from a fluid end assembly towards a power end assembly of a high pressure pump which embodies the features of the present invention.
Figure 3:
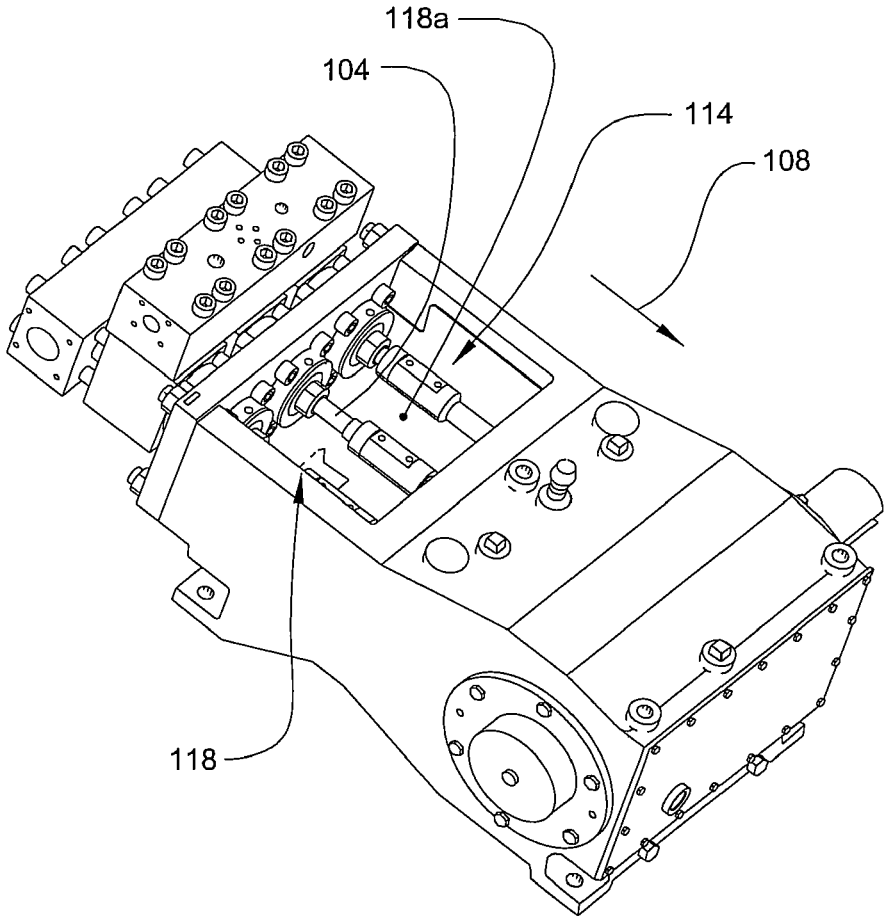
FIG. 3 is an isometric view looking from a power end assembly towards the fluid end assembly of the fluid pump shown in FIG. 2.
Figure 4:
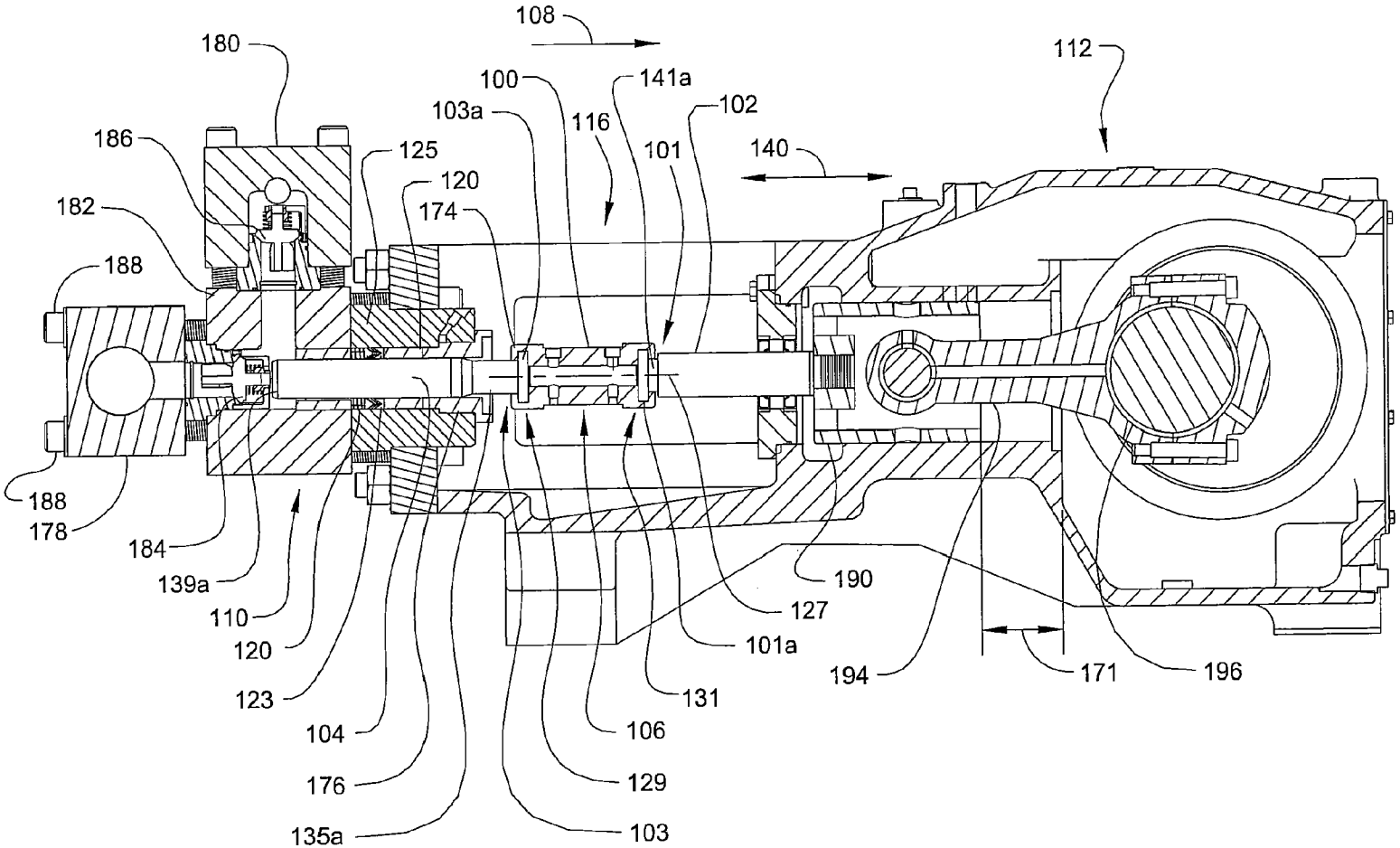
FIG. 4 is an irregular sectional view taken along a longitudinal length of the pump extending from the power end assembly to the fluid end assembly; the pump is at the end of its discharge stroke.
Figure 5:
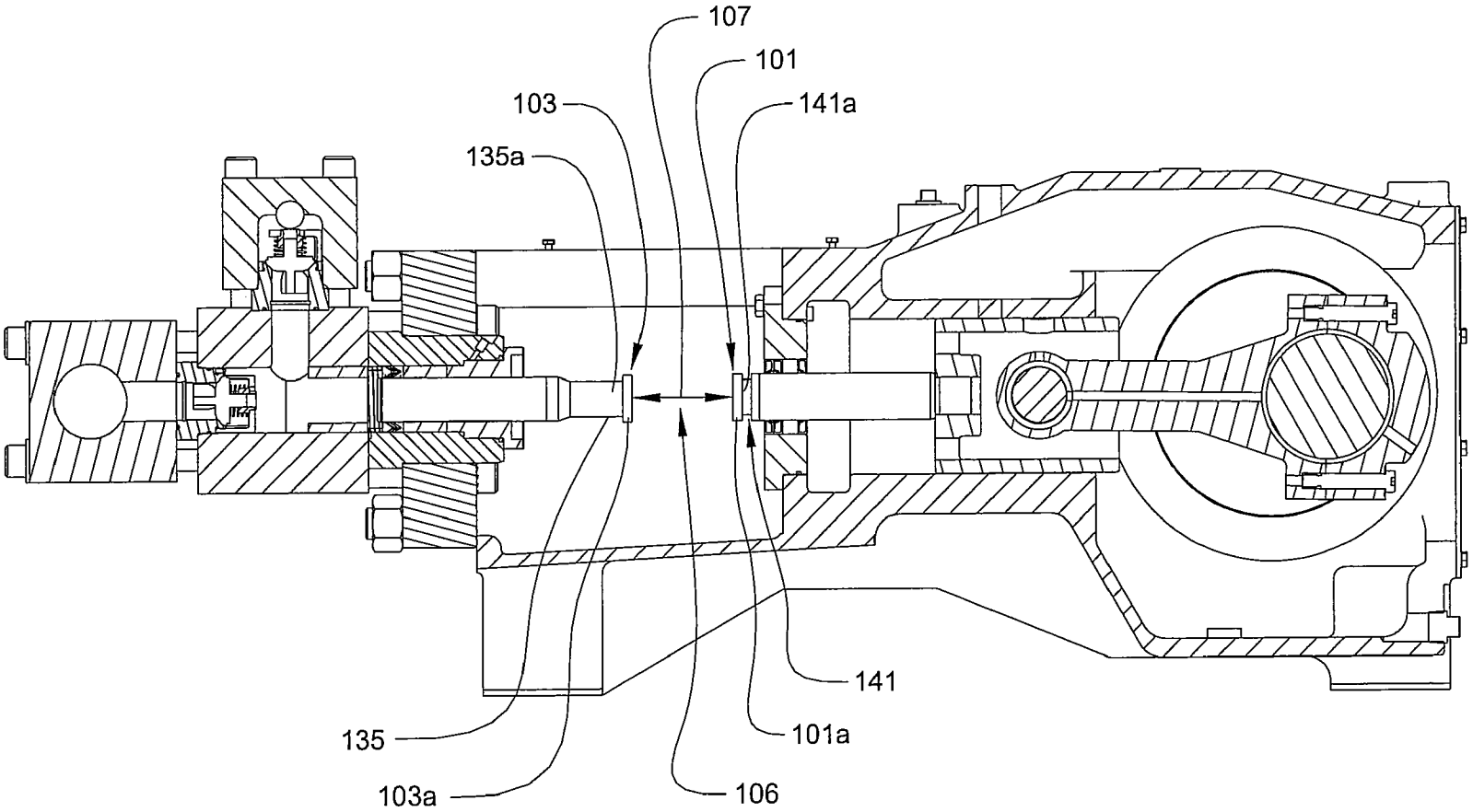
FIG. 5 is the sectional view shown in FIG. 4 except the pump is at the beginning of the discharge stroke and the coupling has been removed to allow for removal of the plunger from the well.
Figure 6:
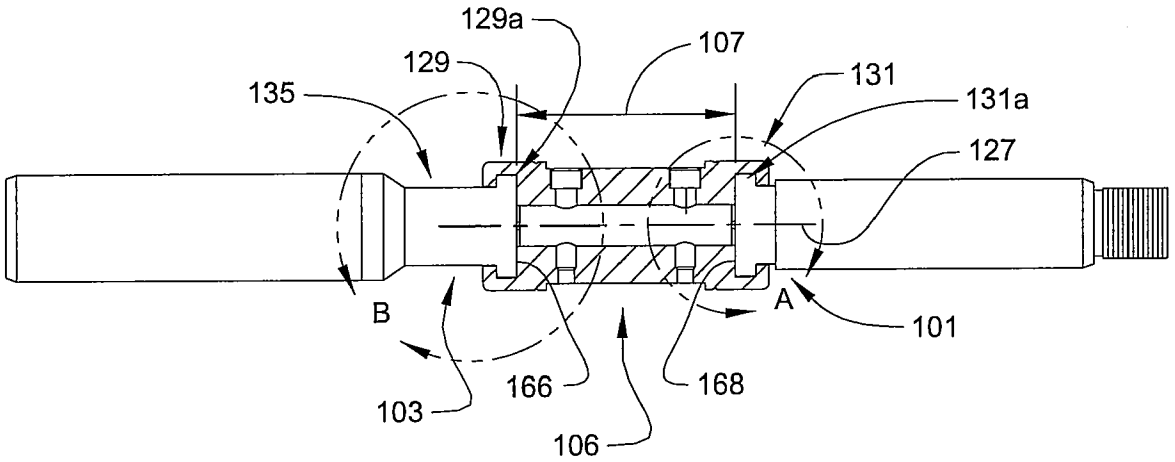
FIG. 6 is a close-up view of the plunger, plunger adaptor, and coupling shown in FIG. 3 removed from the pump; the coupling has been partially sectioned.
Figure 7B:
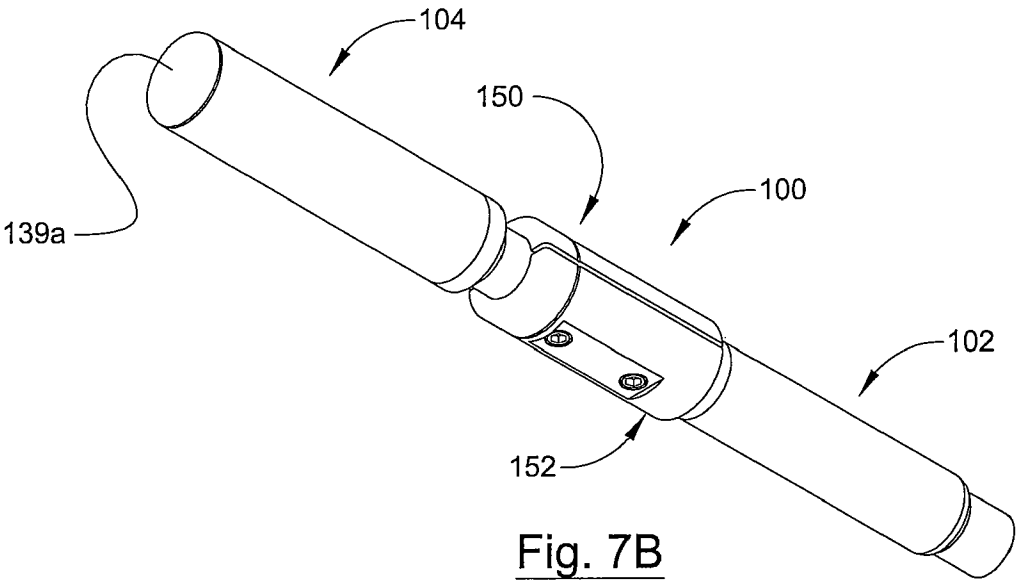
FIG. 7*b* is a perspective view of the assembly shown in FIG. 6.
Figure 7A:
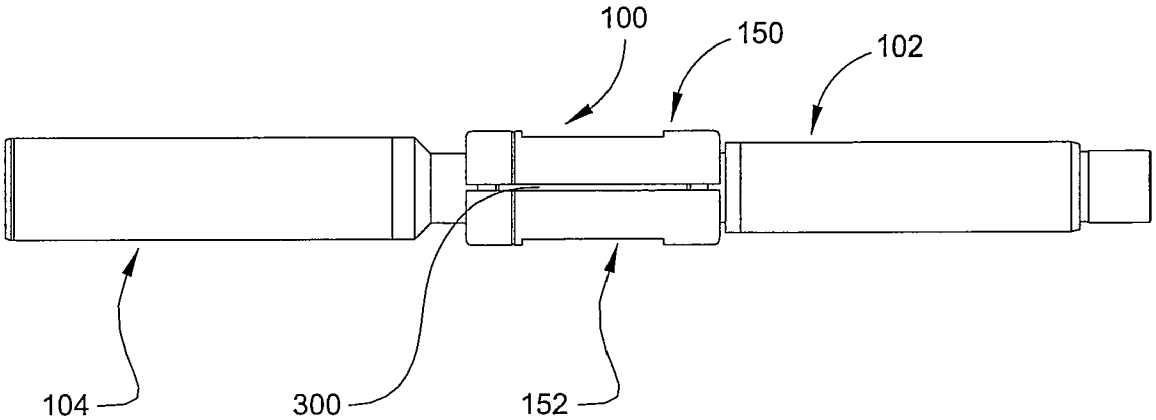
FIG. 7*a* is a view of the assembly shown in FIG. 6 without sectioning the coupling.
Figure 7C:
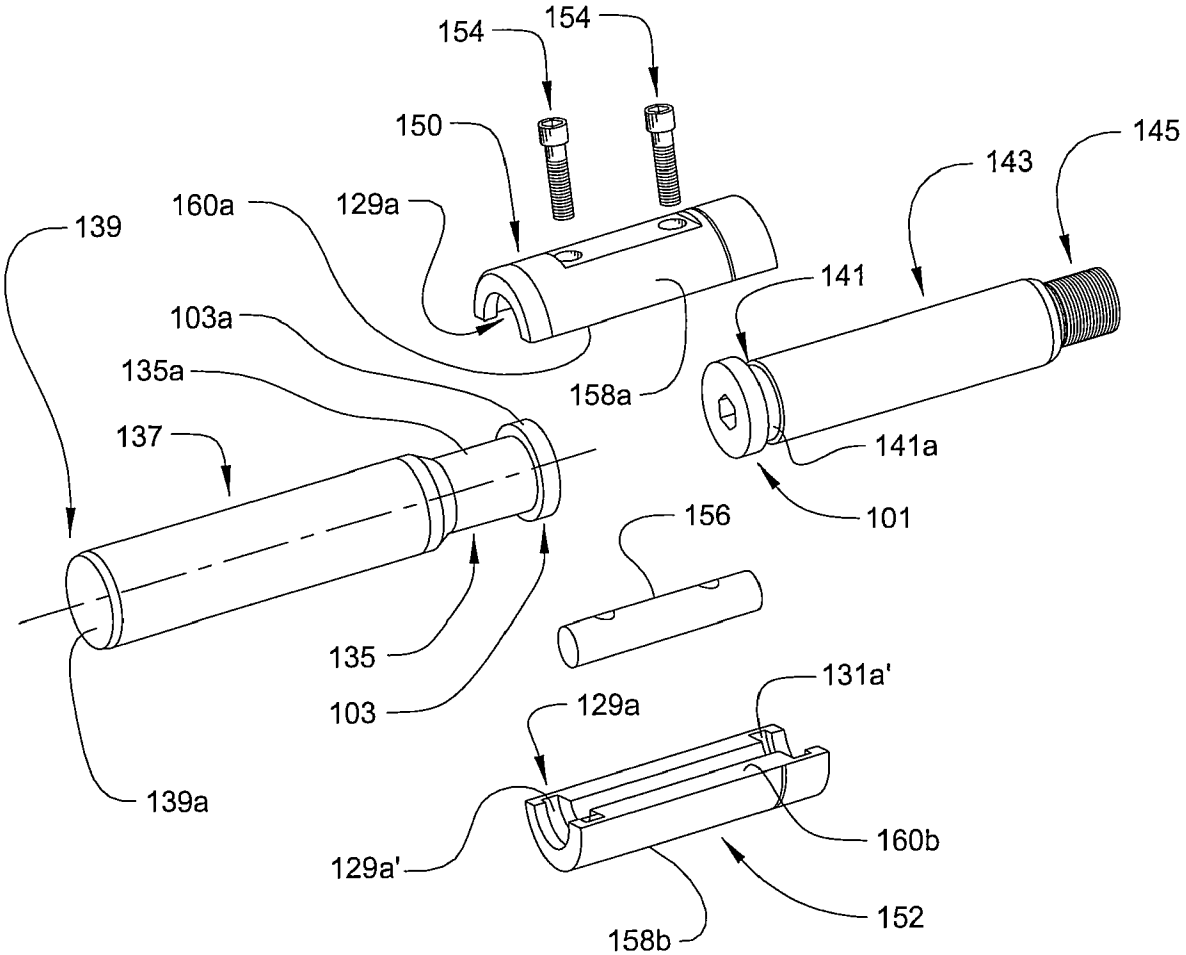
FIG. 7*c* is an exploded view of the assembly shown in FIG. 6.
Figure 8:
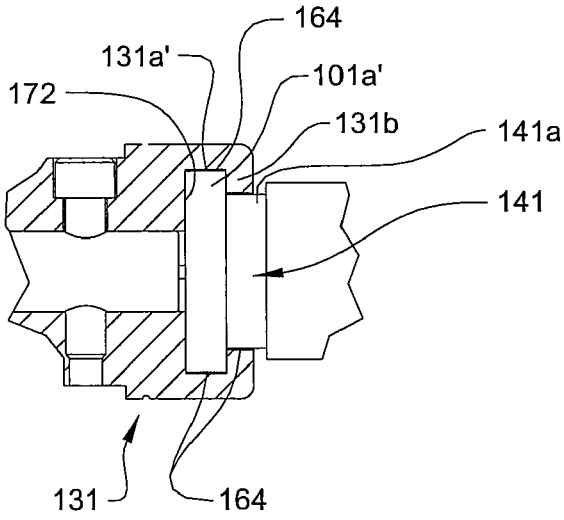
FIG. 8 is a blown-up view of detail A of FIG. 6.
Figure 9:
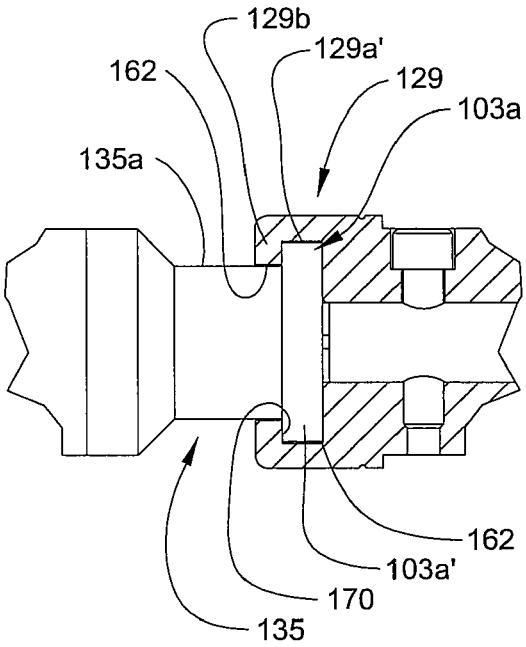
FIG. 9 is a blown-up view of detail B of FIG. 6.

FIGS. 2-9 illustrate and describe a pump embodying the present invention. The pump has a coupling 100 which connects plunger adaptor 102 to plunger 104. The coupling 100 provides, maintains, and allows for a space 106 between a first end 103 of plunger 104 and a first end 101 of plunger adaptor 102 during operation of the pump.

The space 106 facilitates disassembly of plunger 104 from the pump. The space allows for an operator or servicer or other person upon only disconnecting the coupling 100 from the plunger 104 and from the plunger adaptor 102 to remove, via the well 114, the plunger 104 from the rest of the pump assembly. From the well, the operator slides the plunger 104 in a direction 108 away from fluid end assembly 110 towards power end assembly 112. (See FIG. 5) The plunger 104 is slid into well 114 defined by the pump frame 116 and removed from the well 114 through open end 118 of well 114. The well 114 and well open end 118 are large enough for a servicer to directly access the coupling 100 with an average size adult hand. Opposite the open end 118 is a well floor 118*a*. Thus, the plunger 104 can be removed from the rest of the pump with minimal disassembly and returned to the pump with minimal reassembly. The arrangement allows for replacement of the components in stuffing box 125, plunger 104, and plunger adaptor 102 with minimal effort. The components replaced within stuffing box 125 can include bushings 120, spring 122 and packing 123.

The plunger first end 103 forms a flange 103*a* of plunger 104. The flange is circumferential and has a radius greater than the radius of a portion of the plunger immediately adjacent the flange 103*a*. The portion with the smaller radius forms a radially inward surface 135*a* of a recess 135. The recess 135 and flange 103*a* form a plunger first section. Adjacent the recess, opposite the flange, is a second plunger section 137 with a radius greater than the radius of the radially inward surface 135*a*. Plunger second section has an end which has an end surface 139*a*. The end surface forms a plunger second 139.

The plunger adaptor first end 101 forms a flange 101*a* of plunger adaptor 102. The flange is circumferential and has a radius greater than the radius of a portion of the plunger adaptor immediately adjacent plunger adaptor flange 101*a*. The portion with the smaller radius forms a radially inward surface 141*a* of a recess 141. The recess 141 and flange 101*a* form a plunger adapter first section. Adjacent the recess, opposite the flange, is second plunger adaptor section 143 with a radius greater than the radius of the radially inward surface 141*a*. The plunger adaptor second section has an end which forms a plunger adaptor second end 145.

The coupling has a first end 129 which has a first recess 129*a*. The recess is circumferential. The coupling has a second end 131 which has a second recess 131*a*. The recess is circumferential.

Coupling 100 when coupled to plunger 104 and plunger adaptor 102 has a particular arrangement. Coupling 100 spans at least the longitudinal length 107 of space 106. The length 107 can be measured along longitudinal axis 127 of coupling 100. Coupling 100, at first end 129 is coupled to plunger first end 103. Coupling 100 at second end 131 is coupled to plunger adaptor first end 101. Plunger flange 103*a* is in coupler first recess 129*a* and clamped at coupling first end 129. Plunger adaptor flange 101*a* is in coupler second recess 131*a* and clamped at coupling second end 131. A portion 13 lb of coupling second end 131 is in plunger adaptor recess 141. A portion 129*b* of coupling first end 129 is in plunger recess 135.

In more detail the coupling has a first section 150 removably coupled to a second section 152. The sections are coupled by hex-head screws 154. A pin or spacer 156, between the first 150 and second 152 sections, separates the sections' along their longitudinal lengths. The screws extend through aperatures of the first coupling section, through the pin separating the first and second sections and into the second coupling section. Each coupling section forms a half of coupling 100. Each half has an arcuate surface 158*a*, 158*b* and an opposite flat surface 160*a*, 160*b*. Pin or spacer has a diameter sufficient to prevent the flat surfaces 160*a*, 160*b* along their longitudinal lengths from abutting each other. Thus the sections 150, 152 do not abut each other.

The clearance 300 between the sections 150, 152 and in particular flat surfaces 160*a*, 160*b* provides a clearance 162 between a surface 129*á* defining coupling first recess 129*a* and a surface 103*á* defining plunger flange 103*a*. The clearance between flat surfaces 160*a*, 160*b* also provides a clearance 164 between a surface 131*á* defining coupling second recess 131*a* and a surface 101*á* defining adaptor flange 101*a*. Each of the recess defining surfaces 129*á*, 131*á* form a radially recessed surface which is circumferential. Each of the flange defining surfaces 101*á*, 103*á* form a radial surface which is circumferential. The clearances 162, 164 between the flange surfaces 101*á*, 103*á* and coupling recess defining surfaces of 129*á*, 131*á* are radial clearances. The clearances extend in the radial direction and span the entire overlap between surfaces 101*á*, 103*á* and surfaces 129*á*, 131*á*.

Clearance 162 is also provided between portion 129*b* of coupling first end 129 and surface 1135*a* of recess 135. The clearance is also radial and spans the entire overlap of surfaces. Clearance 164 is also provided between portion 131*b* of coupling second end 131 and surface 141*a* of recess 141. The clearance is also radial and spans the entire overlap of surfaces.

The clearances allow for plunger first end 103, adaptor first end 101, and coupler 100 to shift relative to each other to help accommodate any misalignment between plunger 104, plunger adaptor 102, and coupler 100 along their axis.

As can be seen, the longitudinal length 107 extends a distance, herein referred to as "X", between an end surface 166 at plunger first end 103 and an end surface 168 of plunger adaptor first end 101 when coupler 100 connects plunger 104 to plunger adaptor 102. The distance X is about the axial distance between an end wall 170 at first coupler end 129 and an end wall 172 at second coupler end 131. The distance "X" is equal to or greater than the length of plunger 104 measured along the plunger's longitudinal axis, less the stroke length 171 of the pump. The distance "X" should be at least a length, measured in the axial and longitudinal direction 140, sufficient to enable a servicer, from the well, to move end surface 139*a* of plunger second end 139 in the axial direction 140 out of stuffing box 125, and through and out of pump frame opening 174 and into well 114, when the plunger is at the beginning of its discharge stroke, and the coupling is removed from the plunger 104 and adaptor 102.

To remove the plunger, a servicer would adjust the pump so that the plunger is at the beginning of its discharge stroke. (See FIG. 5) The servicer would remove coupling 106 and gland nut 176 from stuffing box 125. The plunger 104 would then be pulled out from well 114 without disassembling the suction manifold 178, discharge manifold 180, fluid cylinder block 182, suction valve assembly 184, discharge valve assembly 186, or bolts 188 from the rest of the pump. Also the servicer does not have to remove plunger adaptor 102 from cross head 190. The power end assembly 112 can remain coupled to the frame 116. The plunger adaptor first end 101 may remain in the well. The power end assembly includes connecting rod 194 and crank shaft 196, and cross head 190.

When coupling 100 is connected to plunger 104 and plunger adaptor 102 and in well 114, the pump assembly is in an orientation which can be considered an assembled orientation. When coupling 100 is not connected to plunger 104 and plunger adaptor 102 but plunger adaptor first end and plunger first end are still in well 114, the pump assembly is in an orientation which can be considered a partially disassembled orientation. In the partially disassembled orientation the plunger and plunger adaptor are not connected. In all other respects the assembly is the same. The servicer may select the orientation.

The fluid end assembly 110 includes suction manifold 178, discharge manifold 180, fluid cylinder block 182, suction valve assembly 184, and discharge valve assembly 186. Notably removal of plunger 104 does not require disassembly of the fluid end assembly or uncoupling the fluid end assembly from frame 116.

The invention claimed is:

1. An assembly in a pump, said assembly comprising:

a frame, said frame defining a well, said well having an open end;

a stuffing box engaged with said frame, said stuffing box having an opening;

a plunger, said plunger having a first end with an end surface, said plunger having a second end with an end surface, said plunger linearly movable between a first position, wherein said plunger is at the beginning of a discharge stroke, and a second position, wherein said plunger is at an end of a discharge stroke, said plunger accessible from said well;

a plunger adaptor, said plunger adaptor having a first end with an end surface and a second end, said plunger adaptor linearly movable between a first position, wherein said plunger adaptor is at a beginning of said discharge stroke and a second position, wherein said plunger is at an end of said discharge stroke, said plunger adaptor accessible from said well; and a space is between said plunger and said plunger adaptor; said space has a longitudinal length, said longitudinal length is measured along a longitudinal axis of the plunger;

an orientation selected from a group of orientations consisting of an assembled orientation wherein a coupling connects said plunger to said adaptor, and said coupling spans the longitudinal length; and a partially disassembled orientation wherein said plunger and plunger adaptor are not connected;

and wherein said longitudinal length of said space is at least great enough to enable movement of said end surface of said second plunger end out of said stuffing box and into said well and out of said well open end, when said pump assembly is in said partially disassembled orientation, and when said plunger adaptor first end is in said well.

2. An assembly in a pump, said assembly comprising:

a frame, said frame defining a well, said well having an open end;

a stuffing box engaged with said frame, said stuffing box having an opening;

a plunger, said plunger having a first end with an end surface, said plunger having a second end with an end surface, said plunger linearly movable between a first position, wherein said plunger is at the beginning of a discharge stroke, and a second position, wherein said plunger is at an end of a discharge stroke, said plunger accessible from said well;

a plunger adaptor said plunger adaptor having a first end with an end surface and a second end, said plunger adaptor linearly movable between a first position, wherein said plunger adaptor is at a beginning of said discharge stroke and a second position, wherein said plunger is at an end of said discharge stroke, said plunger adaptor accessible from said well; and a space is between said plunger and said plunger adaptor; said space has a longitudinal length, said longitudinal length is measured along a longitudinal axis of the plunger;

an orientation selected from a group of orientations consisting of an assembled orientation wherein a coupling connects said plunger to said adaptor, and said coupling spans the longitudinal length; and a partially disassembled orientation wherein said plunger and plunger adaptor are not connected;

wherein said longitudinal length of said space is at least great enough to enable movement of said end surface of said second plunger end out of said stuffing box and into said well and out of said well open end, when said pump assembly is in said partially disassembled orientation, and when said plunger adaptor first end is in said well;

wherein when said assembly is in said assembled orientation, said coupling has a first section removably coupled to a second section;

wherein said coupling has a first end with a recess, and said plunger first end is in said recess; and wherein there is a clearance between a surface defining said recess and a surface defining said plunger first end, and said surfaces overlap.

3. The pump assembly of claim 2 wherein said coupling further comprises:

a spacer between said first section and said second section, said spacer preventing said first section from abutting up against said second section.

4. An assembly in a pump, said assembly comprising:

a frame, said frame defining a well, said well having an open end;

a stuffing box engaged with said frame, said stuffing box having an opening;

a plunger, said plunger having a first end with an end surface, said plunger having a second end with an end surface, said plunger linearly movable between a first position, wherein said plunger is at the beginning of a discharge stroke, and a second position, wherein said plunger is at an end of a discharge stroke, said plunger accessible from said well;

a plunger adaptor, said plunger adaptor having a first end with an end surface and a second end, said plunger adaptor linearly movable between a first position, wherein said plunger adaptor is at a beginning of said discharge stroke and a second position, wherein said plunger is at an end of said discharge stroke, said plunger adaptor accessible from said well; and a space is between said plunger and said plunger adaptor; said space has a longitudinal length, said longitudinal length is measured along a longitudinal axis of the plunger;

an orientation selected from a group of orientations consisting of an assembled orientation wherein a coupling connects said plunger to said adaptor, and said coupling spans the longitudinal length; and a partially disassembled orientation wherein said plunger and plunger adaptor are not connected;

wherein said longitudinal length of said space is at least great enough to enable movement of said end surface of said second plunger end out of said stuffing box and into said well and out of said well open end, when said pump assembly is in said partially disassembled orientation, and when said plunger adaptor first end is in said well;

wherein when said assembly is in said assembled orientation, said coupling has a first section removably coupled to a second section; wherein said coupling has a second end with a recess, and said plunger adaptor first end is in said recess; and wherein there is a clearance between a surface defining said recess and a surface defining said plunger adaptor first end, and said surfaces overlap.

5. The assembly of claim 1 wherein when said assembly is in said assembled orientation, said coupling has a first end clamped to said first plunger end.

6. The assembly of claim 1 wherein when said assembly is in said assembled orientation, said coupling has a second end clamped to plunger adaptor first end.

7. A coupling of a pump comprising:

a first end;

a second end;

a longitudinal length between said first end and said second end;

said longitudinal length at least a longitudinal length of a space between a plunger and plunger adaptor of said pump when said coupling connects said plunger to said adaptor; and wherein said longitudinal length of said space is at least great enough to enable removal of an end surface of said plunger out of a stuffing box of said pump and into a well defined by said pump and out of said well through a well open end when said plunger and plunger adaptor are not coupled by said coupling and when said plunger adaptor has a first end within said well.

8. A method for partially disassembling a pump comprising:

disconnecting a plunger from a plunger adaptor;

sliding the plunger in a direction away from a fluid end of said pump and towards a power end of said pump and into a well defined by said pump;

removing the plunger from an open end of said well without disconnecting a power end assembly from a frame of said pump.

* * * * *